US005400431A

United States Patent [19]

Koo

[11] Patent Number: 5,400,431

[45] Date of Patent: Mar. 21, 1995

[54] ARTIFICIAL FLOWER

[75] Inventor: George Y. S. Koo, Kowloon, Hong Kong

[73] Assignee: United Chinese Plastics Products Co., Ltd., Kowloon, Hong Kong

[21] Appl. No.: 63,146

[22] Filed: May 18, 1993

Related U.S. Application Data

[62] Division of Ser. No. 832,218, Feb. 5, 1992, Pat. No. 5,240,526, which is a division of Ser. No. 560,360, Jul. 31, 1990, Pat. No. 5,180,800.

[30] Foreign Application Priority Data

May 17, 1990 [GB] United Kingdom ..... 9011058

[51] Int. Cl.[6] ..... A41G 1/00; F27B 9/10

[52] U.S. Cl. ..... 392/379; 219/388; 219/521; 392/375; 392/407; 428/26

[58] Field of Search ..... 156/61, 81, 82, 84; 264/80; 428/24, 25, 26; 219/388, 521; 392/375, 376, 379, 382, 407, 418, 419

[56] References Cited

U.S. PATENT DOCUMENTS

| | | | |
|---|---|---|---|
| 1,748,636 | 2/1930 | Crockett | 428/26 |
| 2,879,617 | 3/1959 | Popeil | 428/24 X |
| 3,064,308 | 11/1962 | Caspersen | 428/182 X |
| 3,389,535 | 6/1968 | Armetti | 219/388 X |
| 3,634,181 | 1/1972 | Knox | 428/26 X |
| 3,637,982 | 1/1972 | Reaves | 392/379 |
| 3,822,171 | 7/1974 | Bouillot | 428/25 |
| 3,975,618 | 8/1976 | Goos et al. | 392/419 X |
| 4,293,997 | 10/1981 | Lee | 428/24 X |
| 4,324,821 | 4/1982 | Heineman, III | 428/24 |
| 4,333,003 | 6/1982 | Rivera | 392/418 X |
| 4,708,892 | 11/1987 | Young et al. | 428/24 |
| 4,708,893 | 11/1987 | Little et al. | 428/26 |
| 4,767,650 | 8/1988 | Little et al. | 428/26 |
| 4,789,572 | 12/1988 | Weaver | 428/26 |
| 4,808,447 | 2/1989 | Baker | 428/24 X |
| 4,943,455 | 7/1990 | Dixon | 428/26 |
| 4,957,787 | 9/1990 | Reinhardt et al. | 428/24 |

FOREIGN PATENT DOCUMENTS

| | | | |
|---|---|---|---|
| 53-67593 | 6/1978 | Japan | 428/26 |

OTHER PUBLICATIONS

Philippine copyright registration No. G987 (issued Jun. 8, 1990) and copies of photographs.

Japanese Book "Miyuki Art Flower" published in 1988 (p. 141) and partial translation.

*Primary Examiner*—Henry F. Epstein

*Attorney, Agent, or Firm*—Richard M. Goldberg

[57] ABSTRACT

A method and apparatus of making an artificial flower resembling a dried flower, in which the artificial flower has a plurality of petals made from a fabric, each petal having an upper end with a tip, in which the tips of the petals are heated to a temperature sufficient to melt the fabric in the region of the tips by a heating assembly including a heating coil and a blower, and the petals in areas thereof other than the tips, are protected from the heat to prevent melting thereof, by placing the artificial flower in a recess of a heat sink body such that only the tips thereof protrude from the heat sink body, and as a result, a shrivelled, dried-up appearance is imparted to the artificial flower.

16 Claims, 3 Drawing Sheets

FIG.1
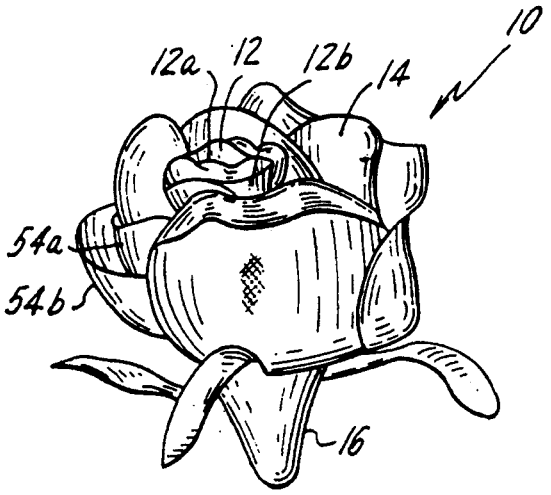
FIG.5
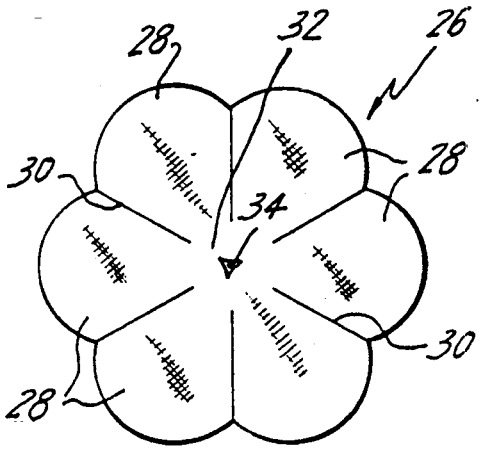
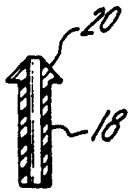
FIG.2
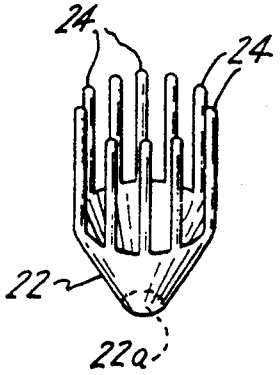
FIG.3
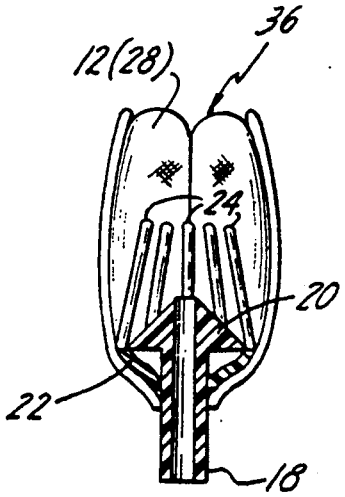
FIG.4

FIG.7
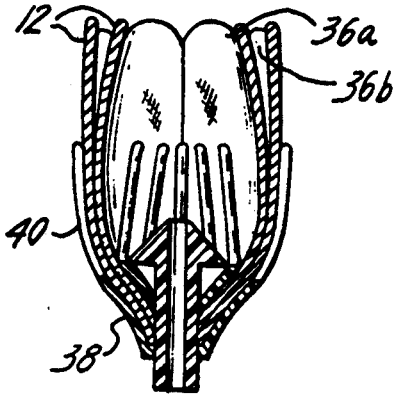
FIG.6
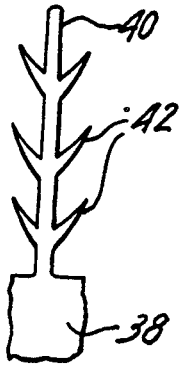
FIG.8
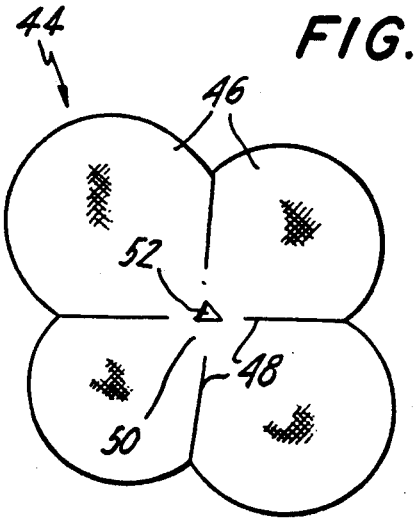
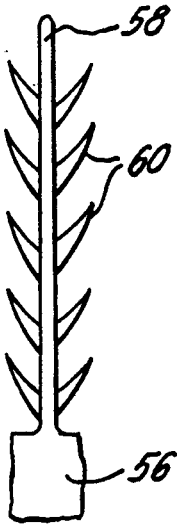
FIG.9
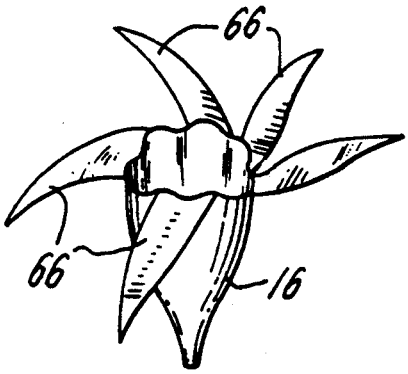
FIG.10
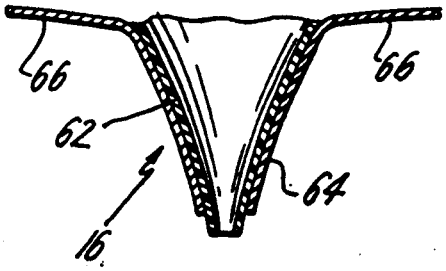
FIG.11

FIG.12
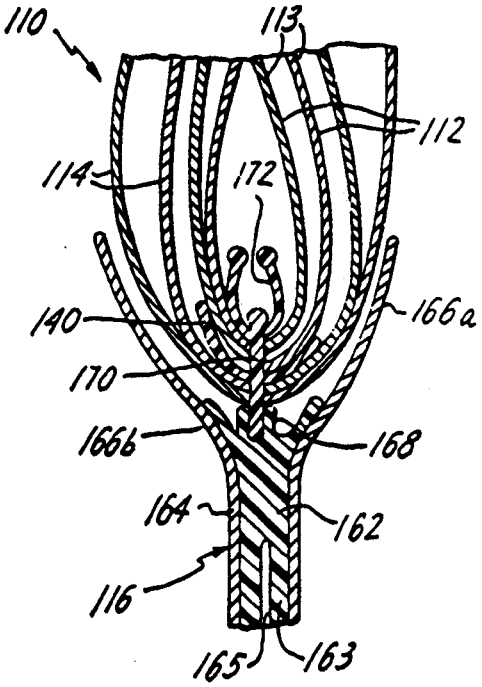
FIG.14
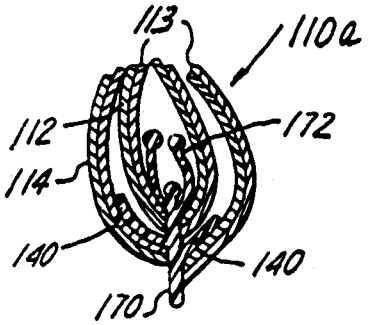
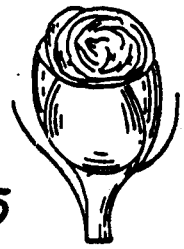
FIG.15
FIG.13
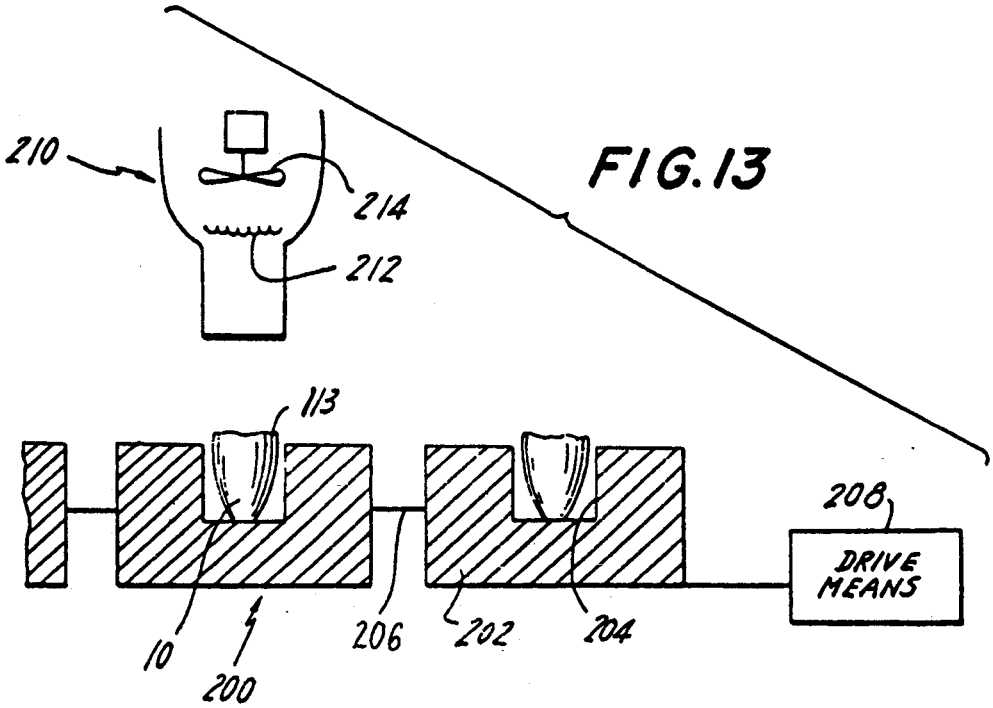

ARTIFICIAL FLOWER

The present application is a division of U.S. patent application Ser. No. 07/832,218, filed Feb. 5, 1992, and issued as U.S. Pat. No. 5,240,526, on Aug. 31, 1993, and which is a division of U.S. patent application Ser. No. 07/560,360, filed Jul. 31, 1990, issued as U.S. Pat. No. 5,108,800, on Apr. 28, 1992.

BACKGROUND OF THE INVENTION

The present invention relates generally to artificial flowers, and more particularly, is directed to an artificial flower that simulates a dried flower.

The accuracy of artificial flowers in simulating real flowers has improved to such an extent that it is difficult to distinguish an artificial flower from a real flower without closely examining the artificial flower.

Such artificial flowers are generally constructed with fabric petals, in which the pieces of fabric used to simulate the petals are molded to a suitable shape, and are colored and/or printed to provide an accurate visual appearance. Generally, a woven polyester fabric is used for the fabric, although other materials or synthetic yarns can also be used. Further, the fabric may be sized with a stiffening agent to help retain the fabric in its molded shape.

Although artificial flowers present a generally decorative appearance, it is sometimes desirable to impart a still more realistic appearance. In this regard, it is noted that dried flowers have such a more realistic appearance. However, because of the manner in which artificial flowers are conventionally made, it would be virtually impossible to make an artificial dried flower in the same way.

OBJECTS AND SUMMARY OF THE INVENTION

Accordingly, it is an object of the present invention to provide an artificial flower that simulates a dried flower.

It is another object of the present invention to provide an artificial flower in which only the tips of the fabric petals are melted or fused to impart the appearance of a dried flower.

It is still another object of the present invention to provide an artificial dried flower that is relatively easy and inexpensive to manufacture.

In accordance with an aspect of the present invention, a method of making an artificial flower resembling a dried flower is provided, in which the artificial flower has a plurality of petals made from a fabric, each petal having an upper end with a tip, the method including the steps of heating the tips of the petals to a temperature sufficient to melt the fabric in the region of the tips, and protecting the petals in areas thereof other than the tips from the heat to prevent melting thereof, wherein a shrivelled, dried-up appearance is imparted to the artificial flower.

In accordance with another aspect of the present invention, an artificial flower resembling a dried flower is provided, in which the artificial flower has a plurality of petals made from a fabric, each petal having an upper end with a tip, the artificial flower being made from the process of heating the tips of the petals to a temperature sufficient to melt the fabric in the region of the tips, and protecting the petals in areas thereof other than the tips from the heat to prevent melting thereof, wherein a shrivelled, dried-up appearance is imparted to the artificial flower.

In accordance with still another aspect of the present invention, an artificial flower which resembles a dried flower is provided, including a plurality of petals made from a fabric, each petal having a main body part and an upper end with a tip, with only the tips being melted to impart an appearance of a dried flower; and a base on which the petals are mounted.

In accordance with yet another aspect of the present invention, apparatus for making an artificial flower resemble a dried flower is provided, in which the artificial flower has a plurality of petals made from a fabric, each petal having an upper end wifh a tip, the apparatus including heating means for heating the tips of the petals to a temperature sufficient to melt the fabric in the region of the tips, and protection means for protecting the petals in areas thereof other than the tips, from the heat to prevent melting thereof, wherein a shrivelled, dried-up appearance is imparted to the artificial flower.

The above and other objects, features and advantages of the present invention will become readily apparent from the following detailed description which is to be read in connection with the accompanying drawings.

BRIEF DESCRIPTION OF THE DRAWINGS

FIG. 1 is a perspective view of a conventional artificial flower;

FIG. 2 is a longitudinal cross-sectional view of a post used for constructing the artificial flower of FIG. 1;

FIG. 3 is a perspective view of a frusto-conical core used for constructing the artificial flower of FIG. 1;

FIG. 4 is a longitudinal cross-sectional view of a sub-assembly of the artificial flower of FIG. 1;

FIG. 5 is a plan view of a fabric used to construct the inner petals of the artificial flower of FIG. 1;

FIG. 6 is a plan view of a portion of another frusto-conical core used for constraining the inner petals of the artificial flower of FIG. 1;

FIG. 7 is a longitudinal cross-sectional view of the entire inner petal sub-assembly of the artificial flower of FIG. 1;

FIG. 8 is a plan view of fabric used to construct the outer petals of the artificial flower of FIG. 1;

FIG. 9 is a plan view of a portion of another frusto-conical core used for constraining the outer petals of the artificial flower of FIG. 1;

FIG. 10 is a perspective view of the pedicel of the artificial flower of FIG. 1;

FIG. 11 is a cross-sectional view of the pedicel of FIG. 10;

FIG. 12 is a cross-sectional view similar to FIG. 7, of another known artificial flower;

FIG. 13 is a cross-sectional view of apparatus according to the present invention for heating an artificial flower to impart a shrivelled, dried look thereto;

FIG. 14 is a cross-sectional view similar of a finished artificial dried flower according to the present invention; and FIG. 15 is a perspective view of the finished artificial dried flower of FIG. 14.

DETAILED DESCRIPTION OF THE PREFERRED EMBODIMENTS

Referring to the drawings in detail, and initially to FIG. 1, a conventional artificial flower 10 is shown having inner petals 12, outer petals 14 and a pedicel 16 which supports the petals. As an example, inner petals 12 can have a red coloration, outer petals a yellow coloration and pedicel 16 a green coloration.

One embodiment for manufacturing flower 10 will now be described. As shown in FIG. 2, a hollow plastic post 18 is formed with a frusto-conical portion 20 at one end thereof, in a mushroom-like configuration. A hollow, plastic frusto-conical core 22 having a plurality of equiangularly arranged shaping fingers 24 extending upwardly in the axial direction thereof is provided, as shown in an enlarged view in FIG. 3. In a preferred embodiment, although not shown for the sake of simplicity in the drawing, fourteen shaping fingers 24 are provided. Core 22 is fitted over post 18, as shown in FIG. 4, and in this regard, the lesser base of core 22 is provided with an opening 22*a* having a diameter similar to the diameter of post 18. Further, the greater base of core 22 has a diameter substantially identical to the greater base of frusto-conical portion 20 and is positioned in abutting relation thereagainst, with shaping fingers 24 extending upwardly around frusto-conical portion 20.

A substantially rosette-shaped fabric 26 having six lobes 28 separated by slits 30 is provided about a hub portion 32 with a central opening 34, as shown in FIG. 5. Lobes 28 are slightly curved at their edges. Thus, when post 18 is inserted through opening 34, lobes 28 wrap around shaping fingers 24, as shown in FIG. 4, to form a first set 36*a* of inner petals 12. As shown in FIGS. 1 and 7, two such cut fabrics 26 are preferably provided about post 18 to form first and second sets 36*a* and 36*b* of inner petals 12. With respect to the example given above, fabric 26 is preferably formed from a woven polyester material, such as polyester, and preferably has a red coloration.

Thereafter, a hollow, plastic frusto-conical core 38, which is identical in configuration and dimensions to core 22, and only a portion of which is thereby shown in FIG. 6, is inserted over post 18 and fabric 26, as shown in FIG. 7. As with core 22, core 38 is provided with a plurality of equiangularly arranged shaping fingers 40. Preferably, twelve such shaping fingers 40 are provided. It is also noted that shaping fingers 40 are provided with barbs 42 to better retain lobes 28 in the configuration shown in FIGS. 1 and 7.

A substantially rosette-shaped fabric 44 having four lobes 46 separated by slits 48 is provided about a hub portion 50 with a central opening 52, as shown in FIG. 8. Lobes 46 are slightly curved at their edges. Thus, when post 18 is inserted through opening 52, lobes 46 wrap around shaping fingers 40 to form a first set 54*a* of outer petals 14. With respect to the example given above, fabric 44 is preferably formed from a woven polyester material, such as polyester, and preferably has a yellow coloration.

Thereafter, a hollow, plastic frusto-conical core 56, which is identical in configuration and dimensions to core 38, and only a portion of which is thereby shown in FIG. 9, is inserted over post 18 and fabric 44. As with core 38, core 56 is provided with a plurality of equiangularly arranged shaping fingers 58. Preferably, twelve such shaping fingers 58 are provided. It is also noted that shaping fingers 58 are provided with barbs 60 to better retain lobes 46 in the configuration shown in FIG. 1. It is further noted that shaping fingers 58 are approximately one and one-half times longer than shaping fingers 40, and accordingly, the number of barbs 60 on shaping fingers 58 is increased.

A second substantially rosette-shaped fabric 44 is then placed over post 18 and core 56. Thus, as shown in FIG. 1, the two fabrics 44 form first and second sets 54*a* and 54*b* of outer petals 14.

Thereafter, pedicel 16 is placed over post 18 with a friction fit. Pedicel 16 has a substantially hollow, plastic frusto-conical portion 62 which fits over post 18 and a fabric portion 64 which is adhered to frusto-conical portion 62. Fabric portion 64 is also provided with sepals 66 which extend outwardly therefrom.

Referring now to FIG. 12, another example of a known artificial flower 110 will now be described in which elements corresponding to those described above with respect to artificial flower 10 are identified by the same numerals augmented by 100, and a detailed description of the common elements will be omitted herein for the sake of brevity.

Specifically, a pedicel 116 is provided in the form of a synthetic plastic molded base 162 having a substantially cylindrical configuration, and including a short stem 163 having a central bore 165 therein so that stem 163 can be attached to a short, flexible rod (not shown) in an artificial flower arrangement. A fabric 164 can be adhered to base 162 so as to form a plurality of sepals 166*a*, and/or sepals 166*b* can be formed as molded portions of base 162.

Further, a central bore 168 is formed at the upper end of base 162, and a plastic style 170 is force fit and/or adhered in bore 168. Style 170 includes a plurality of appendages 172 at the upper free end thereof, and a plurality of shaping fingers 140 substantially mid-way therealong to provide the desired shape for the inner petals 112 and outer petals 114. Specifically, inner petals 112 can be formed from pieces of fabric 126 positioned over style 170 between shaping fingers 140 and appendages 172, and outer petals 114 can be formed from pieces of fabric 144 positioned over style 170 between shaping fingers 140 and base 162. As with artificial flower 10, fabrics 126 and 144 are preferably formed from a woven polyester fabric and are printed and/or colored in a known manner.

In accordance with the present invention, as shown in FIG. 13, apparatus 200 is provided for heating artificial flower 10 or 110, or at least the bloom 110*a* (FIG. 14) thereof, to impart the appearance of a dried natural flower. Bloom 110*a* is that part of the artificial flower without the stem and pedicel, for example, the part shown in FIG. 14.

Specifically, apparatus 200 includes a plurality of interconnected metal trolleys 202, each having a cylindrical central recess 204 therein. The size of each recess 204 is such that tips 113 of petals 112 and 114 are exposed while the remaining main body of the bloom 110*a* is housed within recess 204 and is not exposed. Trolleys 202 are continuously or periodically advanced along a conveyor 206 or the like that is driven by a drive means 208.

A heating section 210 is provided above trolleys 202 at a particular location. As one embodiment, heating section 210 can include a heating coil 212 and blower 214 which directs hot air onto tips 113 of the petals. In a preferred embodiment, a commercial hot air blower can be used with temperatures ranging from 180 degrees C. to 220 degrees C., in which the approximate time for each blast of hot air onto tips 113 will be three to five seconds. It will be appreciated, however, that other heating means can be used, such as an infrared heater or the like. As a result, tips 113 will partially soften and melt or fuse, so as to become shrivelled, dried and stiffer, thereby imparting the appearance of a dried flower. In other words, the tips 113 will contract in the widthwise direction, as shown in FIGS. 14 and 15. There will also be some fading of the dyes used to color the petals, which further adds to the realism of the simulation of a dried flower.

However, the main body of bloom 110*a* is protected from the heat so that only the fabric in the region of tips 113 is melted. This is because each trolley 202 acts as a heat sink, that is, a metal that has good heat conductivity. As a result, any heat which reaches the main body of bloom 110*a* is transferred to the heat sink, and therefore, does not melt the fabric petals except at their exposed tips 113. In reality, however, the main body of the bloom 110*a* will be heated to some degree, which may lead to fading of the colors thereof and perhaps minor shrinking of the material of the petals, thereby adding further to the realism of the simulation.

After being removed from the hot air, the dried bloom 110*a* is allowed to cool within its respective recess 204. Then, trolley 202 is cooled naturally or by additional cooling means, and bloom 110*a* is assembled with base 162 to form the finished dried flower.

Alternatively, bloom 110*a* can be assembled with base 162 prior to the heating operation.

Having described specific preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. Apparatus for making an artificial flower resembling a dried flower, in which the artificial flower has a plurality of petals made from a fabric, each petal having an upper end with a tip, the apparatus comprising:

a heater for heating the tips of the petals to a temperature sufficient to melt the fabric in the region of the tips to impart a shrivelled, dried-up appearance to the artificial flower, and protection means for protecting said petals in areas thereof other than said tips from said heat to prevent melting thereof, said protection means at least partially surrounding said petals in areas thereof other than said tips.

2. Apparatus according to claim 1, wherein said heater includes heating coil means for heating the air, and blower means for blowing air across said heating coil means onto said artificial flower.

3. Apparatus according to claim 1, wherein said heater includes an infrared heater.

4. Apparatus according to claim 1, wherein said protection means includes at least one trolley, each trolley having a recess for receiving an artificial flower and serving as a heat sink for heat imparted to the areas of the petals other than said tips.

5. Apparatus according to claim 1, further including drive means for conveying each said trolley past said heater for a predetermined time period.

6. Apparatus for making an artificial flower resembling a dried flower, in which the artificial flower has a bloom with a plurality of petals made from a fabric, each petal having an upper end with a tip, the apparatus comprising:

a heater which directs heat only against the bloom of the artificial flower and to such an extent so as to melt the fabric substantially only in the region of the tips and to such an extent that a shrivelled, dried-up appearance is imparted to the artificial flower.

7. Apparatus according to claim 6, wherein said heater includes heating coil means for heating the air, and blower means for blowing air across said heating coil means onto said artificial flower.

8. Apparatus according to claim 6, wherein said heater includes an infrared heater.

9. Apparatus according to claim 6, further including protection means for protecting said petals in areas thereof other than said tips from said heat to prevent melting thereof, said protection means at least partially surrounding said petals in areas thereof other than said tips.

10. Apparatus according to claim 9, wherein said protection means includes at least one trolley, each trolley having a recess for receiving an artificial flower and serving as a heat sink for heat imparted to the areas of the petals other than said tips.

11. Apparatus according to claim 10, further including drive means for conveying each said trolley past said heater for a predetermined time period.

12. Apparatus for making an artificial flower resembling a dried flower, in which the artificial flower has a plurality of petals made from a fabric, each petal having an upper end with a tip, the apparatus comprising:

a heater for heating the tips of the petals to a temperature sufficient to melt the fabric in the region of the tips to impart a shrivelled, dried-up appearance to the artificial flower, and protection means for protecting said petals in areas thereof other than said tips from said heat, said protection means at least partially surrounding said petals in areas thereof other than said tips.

13. Apparatus according to claim 12, wherein said heater includes heating coil means for heating the air, and blower means for blowing air across said heating coil means onto said artificial flower.

14. Apparatus according to claim 12, wherein said heater includes an infrared heater.

15. Apparatus according to claim 12, wherein said protection means includes at least one trolley, each trolley having a recess for receiving an artificial flower and serving as a heat sink for heat imparted to the areas of the petals other than said tips.

16. Apparatus according to claim 15, further including drive means for conveying each said trolley past said heater for a predetermined time period.

* * * * *

UNITED STATES PATENT AND TRADEMARK OFFICE

CERTIFICATE OF CORRECTION

PATENT NO. : 5,400,431

DATED : March 21, 1995

INVENTOR(S) : George Y.S. Koo

It is certified that error appears in the above-indentified patent and that said Letters Patent is hereby corrected as shown below:

Column 6, line 1, change "1" to --4--.

Signed and Sealed this

Thirtieth Day of May, 1995

*Attest:*

Bruce Lehman

BRUCE LEHMAN

*Attesting Officer*

*Commissioner of Patents and Trademarks*